United States Patent [19]

Alberts

[11] 4,271,548

[45] Jun. 9, 1981

[54] MOTORBOAT TRANSOM PROTECTOR

[76] Inventor: Terrance M. Alberts, 1919 N. Clinton, Saginaw, Mich. 48602

[21] Appl. No.: 973,698

[22] Filed: Dec. 27, 1978

[51] Int. Cl.[3] ..... B63B 17/00

[52] U.S. Cl. ..... 9/1.5; 248/640; 440/113

[58] Field of Search ..... 9/1.1, 1.5, 2 C; 114/219; 248/640, 643, 674; 24/255 R; 440/113, 900

[56] References Cited

U.S. PATENT DOCUMENTS

| | | | |
|---|---|---|---|
| 3,106,375 | 10/1963 | Donaldson | 248/643 |
| 3,984,887 | 10/1976 | Tanemoto | 9/2 C |
| 4,040,586 | 8/1977 | Newsteder | 248/674 |
| 4,055,874 | 11/1977 | Brown | 24/255 R |

FOREIGN PATENT DOCUMENTS

| | | | |
|---|---|---|---|
| 1527581 | 5/1968 | France | 24/255 |

*Primary Examiner*—Sherman D. Basinger
*Attorney, Agent, or Firm*—John J. Swartz

[57] ABSTRACT

A guard for protecting a boat transom from being marred by a marine motor mounted on the transom, comprising a generally U-shaped marine motor mounting protector, adapted to be mounted on the transom, including a base and a pair of legs mounted on the base for extending along the sides of the transom to provide a barrier between the transom and any motor to be mounted on the transom.

12 Claims, 7 Drawing Figures

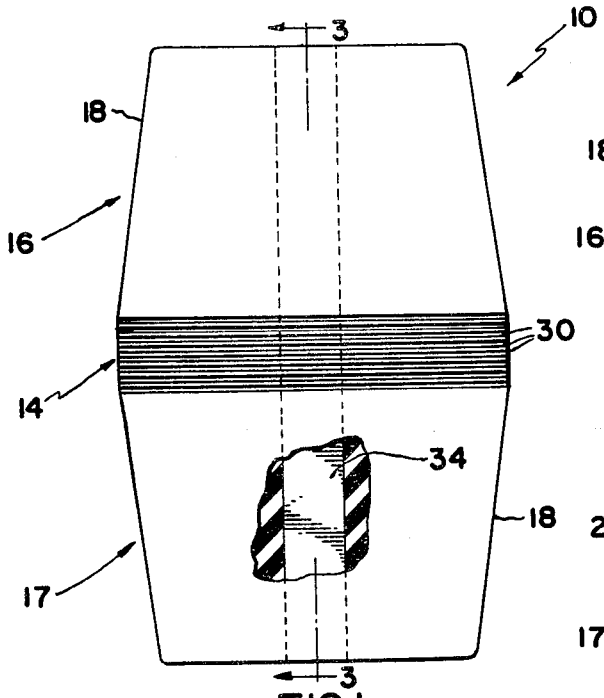
FIG.1
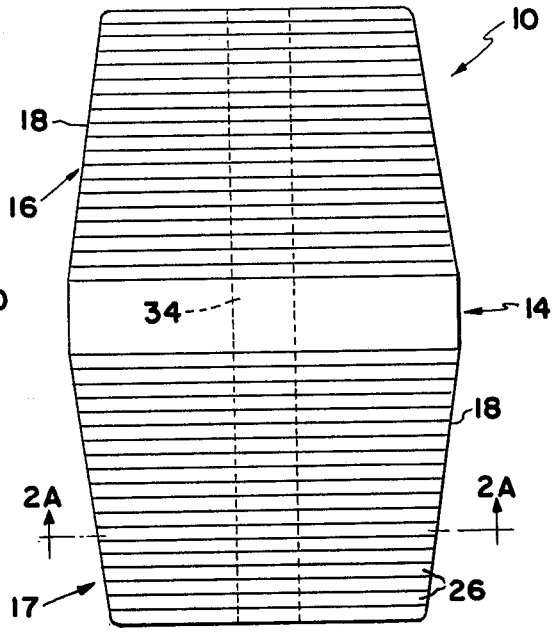
FIG.2
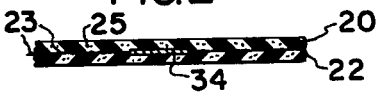
FIG.2A
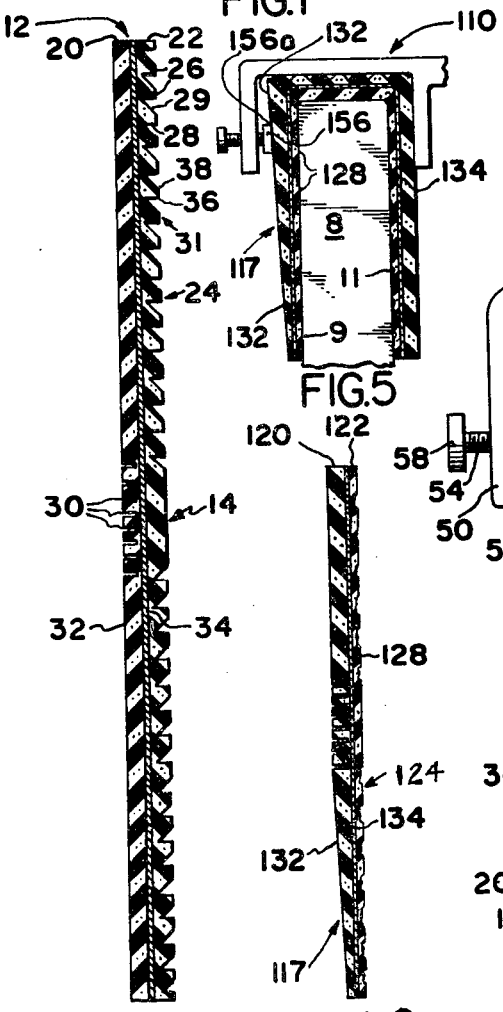
FIG.3
FIG.5
FIG.6
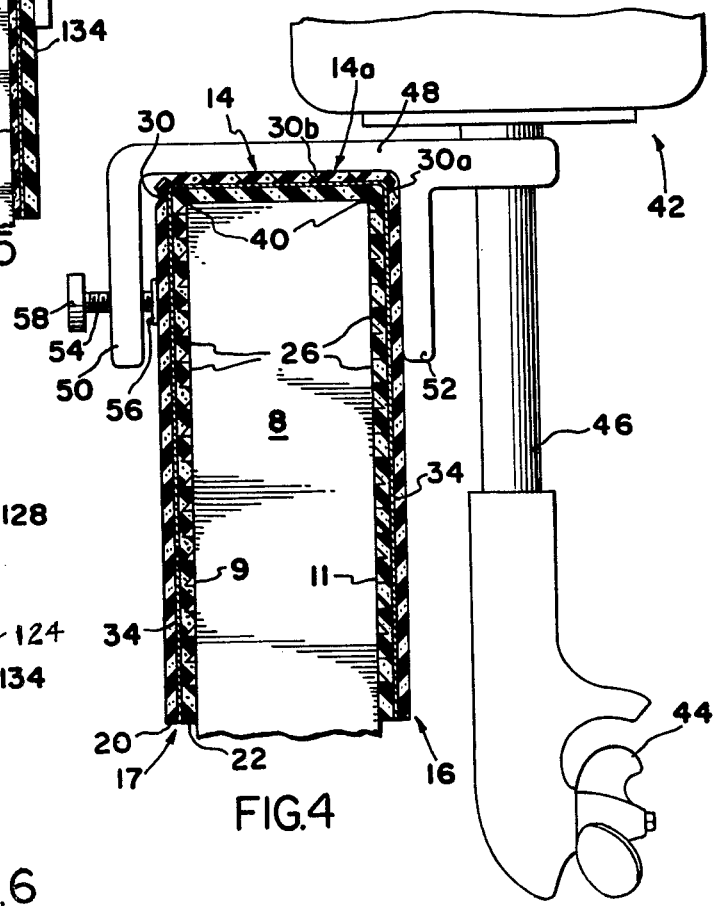
FIG.4

MOTORBOAT TRANSOM PROTECTOR

BACKGROUND OF THE INVENTION

This invention relates to a motor boat transom protector, and more particularly to a yieldable guard which can be configured to conform to the outline of the sternboard of a motor boat to isolate the sternboard from a motor mounted thereon.

Outboard marine motors are conventionally mounted on the transom of a boat via clamps including hand operated, threaded screws mounting relatively hard metal pads which bear against the inside surface of the transom. When the motor is to be mounted, the screws are unturned to retract the pads to positions removed from the sternboard permitting free movement of the pads relative to the sternboard. When the motor is properly positioned on the sternboard, the screws are turned to force the pads to bear against the transom surface and mar the finish. During use of the boat and motor, vibration will sometimes cause the threaded screws to partially unturn and thus move the pads out of snug engagement with the transom. The thus loosened, vibrating pads will sometimes scratch the transom surface.

Accordingly, it is an object of the present invention to provide a new and novel guard which will protect the transom from being marred by a motor mounted on the transom.

It is a further object of the present invention to provide a motor boat transom guard including a pliable sheet of material having opposite end sections, and an intermediate sheet section, joined to the end section, urging the end sections to inoperative positions in which they lie in the same plane, but permitting movement thereof to the confronting positions in which they bear against the inner and outer surfaces of the transom.

Another object of the present invention is to provide a transom protector which will conform to the outline of transoms having differing thicknesses.

Still another object of the present invention is to provide a guard of the type described including bend facilitating slits at the junction of the legs and the base to enhance bending movement of the legs relative to the base, to conform the guard to the shape of the transom.

Yet another object of the present invention is to provide a transom protector of the type described including mechanism for retaining the legs along opposite sides of the transom when the motor is being installed or removed.

If the motor and boat are subjected to substantial shock and vibration, as sometimes occurs, when the motor and boat are trailer-transported over long distances, for example, the screws unturn and the pads become loose from the transom. If the trailer which mounts the boat and motor negotiates a substantial bump in the road, the motor will sometimes be propelled off the transom. Likewisely, if the pads are not sufficiently secured to the transom when the boat is in the water and the submerged motor propeller strikes a submerged article, the motor will sometimes be forced upwardly off the transom and into the water. Accordingly, a further object of the present invention is to provide a transom protector of the type described which will inhibit inadvertent removal of the motor from the boat.

A still further object of the present invention is to provide a motor boat transom protector of the type described which includes downwardly inwardly coverging surfaces against which the pads will bear.

Another object of the present invention is to provide a transom guard of the type described including internally projecting ribs which bear against the transom to inhibit sliding movement of the guard on the transom.

Other objects of the present invention will become apparent to those of ordinary skill in the art as the description thereof proceeds.

SUMMARY OF THE INVENTION

A guard for protecting a motor boat transom having generally upstanding inner and outer faces spanned by a top surface comprising a pliable sheet of material having opposite end sheet sections for bearing against the inner and outer faces of the transom and an intermediate sheet section joined to the end sections, urging the end sections to inoperative positions in which they lie in the same plane, but permitting movement thereof to confronting positions adapted to bear against the inner and outer surfaces of the transom.

The present invention may more readily be understood by reference to the accompanying drawings, in which:

FIG. 1 is a top plan view of a motor boat transom guard constructed according to the present invention, part of the guard being broken away to more clearly illustrate the retaining stays therein;

FIG. 2 is an underplan view of the guard illustrated in FIG. 1;

FIG. 2A is a sectional end view, taken along the line 2A—2A of FIG. 2;

FIG. 3 is a sectional side view, taken along the line 3—3 of FIG. 1;

FIG. 4 is an enlarged sectional end view illustrating the guard mounted on a transom;

FIG. 5 is a sectional end view, similar to FIG. 4, illustrating slightly modified guard mounted on the transom of a boat; and FIG. 6 is a sectional side view, similar to FIG. 3, illustrating the slightly modified construction illustrated in FIG. 5.

DESCRIPTION OF THE PREFERRED EMBODIMENT

Transom protector apparatus constructed according to the present invention, generally designated 10, is mounted on a sternboard, generally designated 8 (FIG. 4), including an inner surface 9 and an exterior surface 11. Referring now more particularly to FIGS. 1–4, the transom protector 10 includes a composite sheet of initially, generally planar material, generally designated 12, having an intermediate sheet section, generally designated 14, integrally joined to end sheet sections 16 and 17. As illustrated in FIGS. 1 and 2, the intermediate sheet section 14 is generally rectangular, whereas the end sections 16 and 17 are trapezoidally shaped and include outwardly converging, lateral side edges 18. The construction of sheet 12 may be similar to a conventional motor vehicle tire construction and includes laminated, outer and inner layers 20 and 22 which may suitably comprise rubber or other resilient material having a plurality of longitudinally extending, threads 25 such as nylon, embedded therein for added rigidity and strength. The layers 20 and 22 may be heated to a suitable temperature and fuzed together or, if desired, they may be coupled together via a layer 23 (FIG. 2A) of suitable epoxy. If desired, the sheet 12 may comprise a one piece molded rubber construction without laminations.

The inner layer 22 comprises a face, generally designated 24, including a plurality of longitudinally disposed, laterally extending teeth 26, each having a longitudinally inner surface 28, which is generally perpendicular to the plane of the sheet 12, and a longitudinally outer inclined surface 29. The surfaces 28 and 29 converge outwardly and terminate on opposite ends of a planar tooth surface 31. It should be noted that the tooth surfaces 29 at opposite end sections 16 and 17 are oppositely inclined. The tooth faces 28 and 29 are joined to planar tooth faces 31 at a plurality of laterally extending, longitudinally spaced edges 36 and 38 which bear against the inner and outer sternboard faces 9 and 11 to inhibit sliding movement of the protector 10 when it is mounted on the stern 8 as viewed in FIG. 4. The intermediate section portion 14*a* of sheet 22 includes a plurality of longitudinally spaced, laterally extending slits 30, along the outer surface 32, which expand from the closed positions illustrated in FIG. 3 to the open position illustrated in FIG. 4 when the protector 10 is installed on the stern 8.

The layers 20, 22, which comprise resilient material, such as rubber, yieldably urge the legs or end portions 16 & 17 to the positions illustrated in FIG. 3 in which they lie in the same plane.

A laterally central longitudinally extending, deformable metal strip 34 is positioned between the layers 20, 22.

When the protector 10 is to be mounted on the transom 8, the shape of the protector is changed from a generally planar shape to a generally inverted U-shape. To accomplish this change of shape, the legs or end portions 16 and 17 are forced downwardly relative to the intermediate portion 14 to the generally parallel positions illustrated in FIG. 4 abutting opposite side surface 9 and 11 of the sternboard 8. When the guard 10 is in the position illustrated in FIG. 4, the endmost slits 30*a* enhance the bending of the layer 20 around the uppermost corners 40 of the sternboard 8. When the legs 16 and 17 are moved to parallel positions, the metal strip 34 is deformed from the planar position illustrated in FIG. 3 to the inverted U-shaped position illustrated in FIG. 4. When the metal strip is thus deformed, the metal sets in the deformed condition and resists return movement of the resilient material 20, 22 to the positions illustrated in FIG. 3.

If a sternboard 8 has a lesser width than the width of the sternboard illustrated in FIG. 4, the inner slits, such as illustrated at 30*b*, will assist longitudinally inner portions of the intermediate section 14 to bend around the sternboard corners 40.

In the position of the protector illustrated in FIG. 4, the teeth 26 of leg 16, which bear against the outer surface 11, will be inclined to inhibit upward movement of the protector 10. The teeth 26 on the opposite end, or leg 17, which bear against the inner sternboard surface 9, will also be inclined so as to inhibit upward movement of the protector 10 on the sternboard 8. The strip 34 functions to retain the protector 10 when a marine motor, schematically designated 42, is mounted on the guard 10 mounted on the sternboard 8.

The motor 42 includes a propeller 44 mounted on a conventional drive shaft 46 which conventionally depends to a level below the water surface. The marine motor 42 is mounted on the sternboard 8 via a suitable clamp, such as illustrated at 48, including a pair of spaced apart legs 50 and 52. One or more thumb screws 54 are threadedly received in the leg 50 and each universally mounts a relatively hard, metal pad 56 which bears against the outer guard surface 32. A thumb operated handle 58 is mounted on the opposite end of the screw 54 as usual.

The resilient layers 20, 22 will protect the surface 9 and 11 from being marred by the pads 56 when the screws 54 are turned so as to tightly clamp the pads 56 to the guard 10 mounted on the sternboard 8. In the event that the screws 54 inadvertently unturn, the pads 56 will bear against the layer 20 and will not mar the surface 9.

ALTERNATE EMBODIMENT

Referring now more particularly to FIGS. 5 and 6, a slightly modified guard 110 is illustrated and is similar in many respects to the guard or protector 10 illustrated in FIGS. 1–4. Generally similar parts will be identified by generally similar numerals preceeded by the digit 1. In the embodiment illustrated in FIGS. 5 and 6, the leg or end portion 117 includes a beveled or tapering surface 132 which converges longitudinally outwardly toward the inner surface 124 of layer 122. The thickness of the longitudinally inner portion of leg 117 is substantially greater than the thickness of the terminal end portion. In the embodiment illustrated in FIGS. 5 and 6, the inner surface 124 of layer 122 includes a plurality of rectangularly shaped ridges or projections 128 which present a plurality of outwardly projecting teeth for bearing against the inner and outer surfaces 9, 11 of the sternboard 8. In the embodiment illustrated in FIGS. 5 and 6, the upper edges 156*a* of pads 156 will bite into the surface 132. In the event that the screw 154 unturns, the pads 156 are not tightly applied, and the pads 156 tend to move upwardly, the edges 156*a* will dig into the surface 132 and inhibit upward movement of the motor. In the event that the propeller shaft 46 hits an underwater barrier or the like, force will be transmitted up through the shaft 46 tending to pull the clamp 48 and motor 42 upwardly. As the unit tends to move upwardly, the upper edge 156A will bite into the outer surface 132 of leg 17, inhibiting upward movement.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. A guard for protecting a motor boat transom having first and second generally upstanding, faces spaced by a top surface said guard comprising:

a one-piece pliable sheet of material having opposite end sheet sections for bearing against said first and second faces of said transom, and an intermediate sheet section, joined to said end section, urging said end sections to inoperative positions in which they lie in the same plane, but permitting movement thereof to confronting positions adapted to bear against said first and second faces of said transom;

one of said end sections of said sheet including a terminal end sheet portion of predetermined thickness and another sheet portion adjacent said intermediate sheet section of a greater predetermined thickness; and deformable stay means, spanning said end sheet sections and said intermediate sheet section, deformable with said end sheet sections from said inoperative positions to deformed confronting positions in which said deformable stay means sets and inhibits return movement of said end sheet sections to said inoperative positions;

said end sheet sections including a plurality of inwardly projecting ribs thereon for bearing against said transom to inhibit movement of said end sheet sections relative to said transom.

2. The guard set forth in claim 1 wherein said stay means comprises a deformable strip extending substantially the entire length of said guard.

3. The guard set forth in claim 2 wherein said strip is embedded in said sheet.

4. The guard set forth in claim 1 wherein longitudinally spaced, laterally extending relieved portions are provided at the junctions of said end sheet sections and said intermediate sheet section which facilitate movement of said end sheet sections, relative to said intermediate sheet section to said confronting positions.

5. The guard set forth in claim 4 wherein said intermediate sheet section includes a plurality of longitudinally spaced, laterally extending, relieved portions which enhance movement of selected portions of said intermediate section to positions in the plane of said end sections when said end sections are in said confronting positions.

6. The guard set forth in claim 1 wherein said sheet comprises first and second laminated layers, said first layer having said plurality of projecting ribs thereon.

7. The guard setforth in claim 6 wherein said plurality of ribs includes a plurality of teeth on each of said end sheet sections oriented oppositely to the teeth on the other end sheet section.

8. The guard set forth in claim 7 wherein said second layer includes a plurality of slits therein, at said intermediate section, between said teeth to enhance bending of said end sheet sections relative to said intermediate sheet section.

9. The guard set forth in claim 1 wherein said guard is generally U-shaped in cross section when said end sheet sections are in said confronting positions.

10. A guard for protecting a boat transom from being marred by a marine motor mounted on the transom comprising:

a one piece, generally U-shaped marine motor mounting protector adapted to be detachably mounted on said transom including:

a base having an intermediate portion provided with an inner face for bearing against said transom and end portions at opposite ends of said intermediate portion provided with an outer face; and a pair of depending, spaced apart legs, integral with said end portions of said base for extending along the sides of said transom to provide a barrier between the transom and any motor to be mounted on said transom;

a plurality of longitudinally spaced, laterally extending recessed portions provided in said outer face for facilitating movement of said end portions of said base relative to intermediate portions of said base so that the length of the base can be adjusted to transoms of differing thicknesses;

the thickness of the portion of one of said legs adjacent said base being greater than the thickness of the terminal end of said one leg;

said U-shaped protector comprises a sheet of yieldable material which will yield to conform to the shape of the transom;

said sheet of yieldable material comprising resilient material normally urging said legs to spread, generally planar positions in directions away from each other; and means on said sheet for retaining said sheet in position on said transom;

said retaining means comprising deformable material which is deformable with said resilient material to deformed positions to generally conform to the outline of said transom but which will set in the deformed condition and resist spreading movement of said legs to said spread positions.

11. The guard setforth in claim 10 wherein said means for retaining said sheet in position on said transom further includes a plurality of ribs projecting from said legs for bearing against said transom.

12. The guard set forth in claim 10 wherein the other of said legs has a substantial uniform thickness, each of said legs including lateral side edges which converge in a direction away from said base.

* * * * *